United States Patent [19]

Wilson et al.

[11] 4,395,161

[45] Jul. 26, 1983

[54] TRANSITION PLATE FOR A MINE ROOF TRUSS

[75] Inventors: Edwin B. Wilson, Quakertown; C. Frederick Eben, Laureldale; Charles L. Meyer, Bethlehem; Charles W. Schaeffer, Lebanon, all of Pa.

[73] Assignee: Bethlehem Steel Corporation, Bethlehem, Pa.

[21] Appl. No.: 323,151

[22] Filed: Nov. 19, 1981

[51] Int. Cl.[3] ..... E21D 20/00

[52] U.S. Cl. ..... 405/259; 405/288

[58] Field of Search ..... 405/259, 260, 261, 288, 405/290, 258

[56] References Cited

U.S. PATENT DOCUMENTS

| | | | |
|---|---|---|---|
| 1,559,560 | 11/1925 | Doughty | 61/45 |
| 2,371,789 | 3/1945 | Batten | 405/290 |
| 2,667,037 | 1/1954 | Thomas et al. | 61/45 |
| 3,415,066 | 12/1968 | Williams | 405/260 |
| 3,427,811 | 2/1969 | White | 61/45 |
| 3,505,824 | 4/1970 | White | 61/45 |
| 3,507,121 | 4/1970 | Morfeldt | 405/260 |
| 3,509,726 | 7/1970 | White | 61/45 |
| 4,349,300 | 9/1982 | Kelley | 405/259 X |

FOREIGN PATENT DOCUMENTS

| | | | |
|---|---|---|---|
| 646286 | 9/1962 | Italy | 405/288 |

*Primary Examiner*—Nile C. Byers, Jr.

*Attorney, Agent, or Firm*—J. I. Iverson; M. J. Delaney

[57] ABSTRACT

A generally rectangular transition plate for connecting inclined and horizontal chords of a mine roof truss has one face defining a generally flat planar plate bearing surface adapted to be closely received against a mine roof. The sides and one end of the plate are bent outwardly from the one face. A first opening in the plate adjacent the one end is adapted to receive a mine roof bolt. A second opening in the plate is located adjacent the other end of the plate. A saddle portion extends between the other end of the plate and the second opening and is adapted to receive a truss tie member. The plate has a low profile and sufficient rigidity to sustain the forces present in the truss.

7 Claims, 7 Drawing Figures

FIG. 1
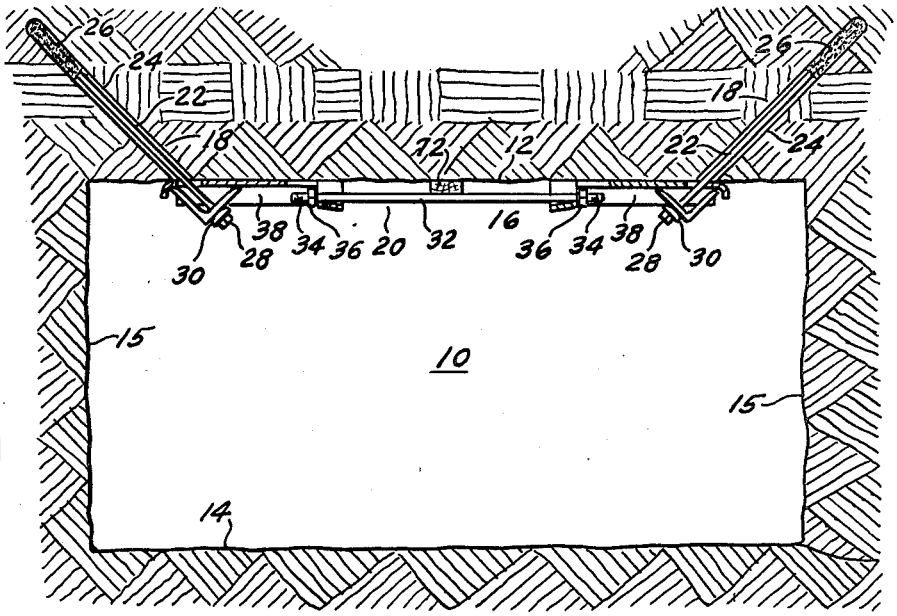
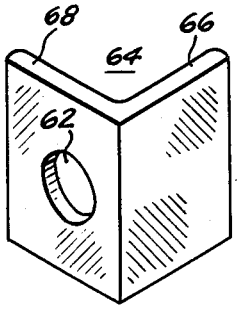
FIG. 7
FIG. 2
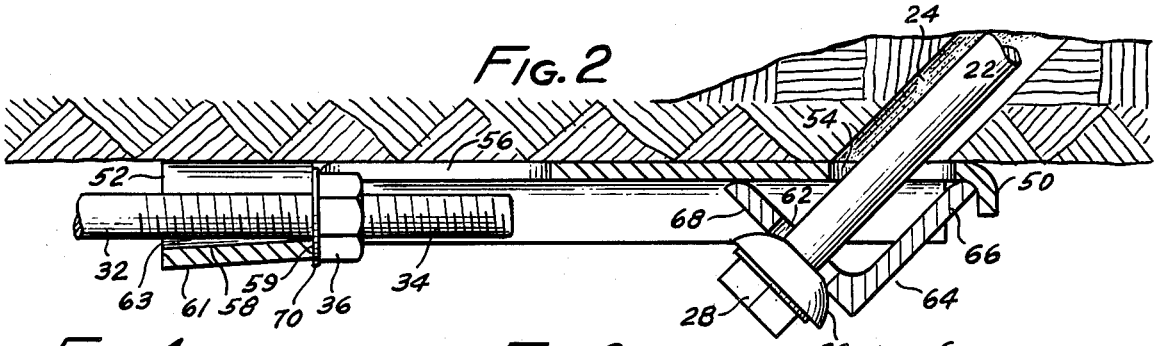
FIG. 4
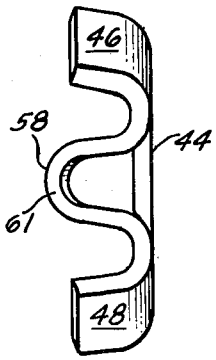
FIG. 3
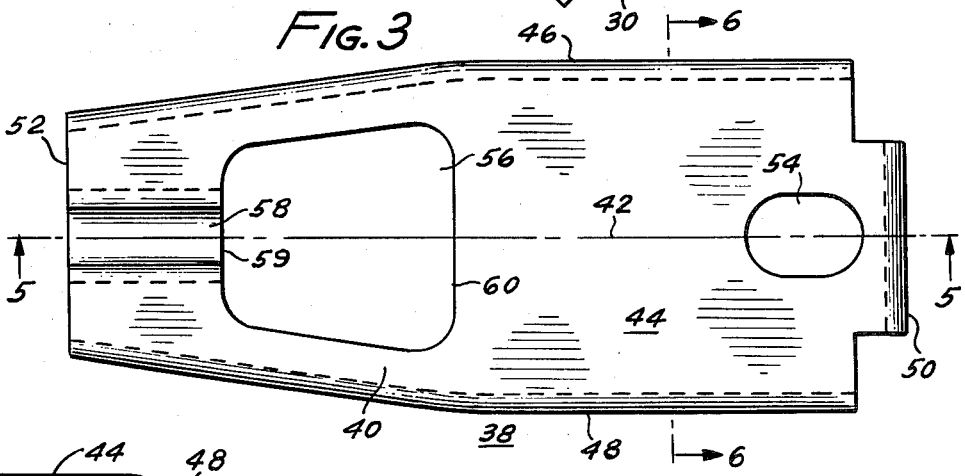
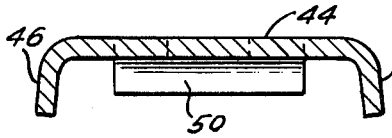
FIG. 6
FIG. 5
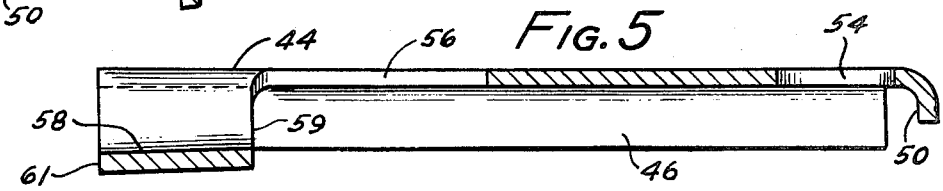

TRANSITION PLATE FOR A MINE ROOF TRUSS

BACKGROUND OF THE INVENTION

This invention relates generally to a mine roof truss and in particular to a transition plate for a mine roof truss. The transition plate joins the inclined and horizontal chords of the mine roof truss.

Mine roof trusses, as shown in U.S. Pat. Nos. 3,509,726 to White (1970): 3,505,824 to White (1970); 3,427,811 to White (1969); 2,667,037 to Thomas et al (1954); and 1,559,560 to Doughty (1925), have been designed to support mine roofs. The trusses include generally two inclined chords and a horizontal chord. The inclined chords are usually mine roof bolts which extend into holes in the mine roof at about a 45° angle. The mine roof bolts are anchored in the holes by well known means such as expansion shells or resin bonding. The horizontal chord or tie member may be made from rods or wire rope.

A critical member of a mine roof truss is the transition plate which ties together the inclined chord members and the horizontal chord member. The transition plate must have sufficient rigidity and strength to withstand the high horizontal and inclined forces. In addition, the transition plate should have a low profile, i.e. extend downwardly from the mine roof a minimum distance so as to allow the maximum working space between the mine floor and the roof. Furthermore, the transition plate should be designed to allow the inclined and horizontal chords to be readily installed and tensioned and be so arranged as to allow the load in the chords to be readily measured. It is also important that the transition plate be relatively light in weight so as to facilitate handling and installation. Finally, the transition plate should be economical to manufacture.

SUMMARY OF THE INVENTION

It is an object of this invention to provide an improved mine roof truss including a unique transition plate for joining together the inclined and horizontal chords of the truss.

It is another object of this invention to provide a mine roof truss transition plate which possesses the required rigidity to withstand the high horizontal and inclined forces present in the truss.

It is still another object of this invention to provide a low profile, lightweight transition plate.

It is a further object of this invention to provide a transition plate which allows the truss chord members to be readily tensioned and attached to the transition plate.

It is a still further object of this invention to provide a transition plate which is economical to manufacture.

The above objects can be accomplished by this invention which is directed primarily to a mine roof truss transition plate comprising a generally rectangular, flat body with one face of the body defining a generally planar surface for bearing against a mine roof. The sides and one end of the body are bent to extend downward from the one face and the mine roof. A first opening is provided in the body adjacent the one end of the body. A second somewhat larger opening is provided in the body adjacent the other end of the body. The first opening is adapted to receive the inclined chord member of the truss. Extending between the other end and the second opening is an integral saddle portion which is spaced from the one face and is adapted to receive the horizontal chord.

BRIEF DESCRIPTION OF THE DRAWINGS

FIG. 1 is an elevation view of the mine roof truss of this invention.

FIG. 2 is an enlarged elevation view, partly in section, of the transition plate of this invention.

FIG. 3 is a plan view of the transition plate of this invention.

FIG. 4 is an end view of FIG. 3.

FIG. 5 is a view taken along the lines 5—5 of FIG. 3.

FIG. 6 is a view taken along the lines 6—6 of FIG. 3.

FIG. 7 is a perspective view of an angle washer used with this invention.

DESCRIPTION OF THE PREFERRED EMBODIMENTS

Referring to FIG. 1, the numeral 10 indicates an underground mine passageway having a mine roof 12, mine floor 14 and mine ribs 15. A mine roof truss 16 comprises two inclined chords 18 and horizontal chord 20.

Each inclined chord 18 comprises a mine roof bolt 22 having its upper end anchored in a hole 24 by resin 26. Referring to FIG. 2, the lower end of the bolt 22 has a head portion 28 which is in contact with a spherical washer 30.

The horizontal chord 20 comprises a tie member 32 having threaded portion 34 at each end for engagement by a nut 36.

Referring to FIGS. 3–6, transition plate 38 comprises a generally flat body 40 having a length greater than the width with a longitudinal axis 42. Face 44 of transition plate 38 has a generally planar surface adapted to bear and be closely received against mine roof 12. The transition plate 38 has a pair of sides 46, 48 which are bent at right angles to face 44 and extend outwardly from the face 44 and downwardly from mine roof 12. The transition plate 38 has a pair of ends 50, 52. End 50 is also bent at a right angle to face 44 and extends outwardly from face 44 and downwardly from mine roof 12.

As best shown in FIG. 3 a first opening 54 is provided in body 40 adjacent end 50. Opening 54 is eliptical in shape with the long axis of the elipse coinciding with longitudinal axis 42. A second larger opening 56 is provided adjacent the other end 52 of body 40.

As best shown in FIGS. 3, 4 and 5, an elongated saddle portion 58 extends outwardly from face 44 and is located along longitudinal axis 42. In forming saddle portion 58 the sides 46 and 48 are pulled toward each other beginning at the innermost end 60 of opening 56. Saddle portion 58 extends from end 52 to opening 56 and forms a groove or tunnel-like opening to accept tie member 32. Referring to FIGS. 2, 3 and 5, saddle portion 58 includes a bearing surface 59 which extends perpendicular to face 44 of transition plate 38 and is located adjacent opening 56. Bearing surface 59 extends parallel to the bearing surfaces of washer 70 and bearing face of nut 36. This arrangement of bearing surfaces assures minimal bending moments and a higher plate strength.

As best shown in FIGS. 3, 4 and 5, saddle portion 58 includes an arcuate outer portion 61 which has a diameter slightly greater than the diameter of tie member 32. The outer portion of arcuate portion 61 is inclined at an angle of about 3 degrees from the longitudinal axis 42 and from the plane of face 44 of transition plate 38. The outer portion of arcuate portion 61 is such that it extends outwardly from bearing surface 59 at about 3 degrees. Thus the outer portion of saddle portion 58 adjacent end 52 is spaced a greater distance from tie member 32 than is the outer portion of saddle portion 58 adjacent bearing surface 59, as best shown in FIG. 2. The greater spacing is designated by the numerical 63. This spacing 63 eliminates interference between the saddle portion 58 and tie member 32 during installation in the event of irregularities in the mine roof 12 and during loading of tie member 32 in the event of bending of any of the truss members.

The shape of the saddle portion 58 provides for effective interconnection of the tie member 32 to the transition plate 38 while retaining the low profile feature of this invention. The low profile feature offers several advantages. Firstly, the shape and position of the saddle portion 58 permits the horizontal force resulting from loading the inclined chord 18 and horizontal chord 20 to be as close as possible to the longitudinal axis 42 of the transition plate 38 thus keeping to a minimum the bending moment experienced by the transition plate 38. By so doing, the transition plate 38 can be relatively light in weight. Secondly, the low profile provides a minimal obstruction to persons and equipment passing through the mine passageway 10. Thirdly, the low profile permits easy application of blocking devices 72 of FIG. 1 which may be made of wood or steel or similar material, between the tie members 32 and mine roof 12.

In addition, the combination of an angle washer 64 having a leg 66 in contact with end 50 and mine roof bolt 22 used to secure the inclined chord 18 to the transition plate 38 offers (a) a low profile, i.e. minimal projection into the mine passageway 10 and (b) a minimum bending moment that might otherwise result in overturning of the assembly.

As best shown in FIG. 2, mine roof bolt 22 extends through opening 54 of transition plate 38 and a hole 62 in angle washer 64. As best shown in FIG. 7 angle washer 64 has one leg 66 and a second leg 68 which includes hole 62 extending perpendicular to leg 66. As best shown in FIG. 2, the end of leg 64 is in contact with the downwardly extending portion of end 50 of body 40 while the end of leg 66 is in contact with body 40. Positioned underneath the head 28 of mine roof bolt 22 is a spherical washer 30.

Referring to FIGS. 1 and 2 tie member 32 has its ends extending within saddle portions 58 of transition plate 38. Positioned on each end of tie member 32 is a hardened steel washer 70 and a nut 36 in threaded engagement with threads 36.

As best shown in FIGS. 1 and 2, nuts 36 and bolt head portion 28 are readily accessible for measuring torque by a torque wrench, an accepted measure of approximate load level in the tie member 32 and bolts 22. By measuring torque, the performance of the truss can be evaluated. In addition, the amount of torque may be an indication of the condition of the mine roof. Thus it is an advantage of this invention to provide for ease in determining torque.

SPECIFIC EXAMPLE

By way of specific example it has been found that a truss system of the invention performs satisfactorily if the various members are made from steel and have the following dimensions:

Transition Plate

Overall length = 14 inches
Overall width = $5\frac{1}{2}$ inches
Thickness of material = 9/32 inch
Maximum height = 2 inches
Length of saddle portion along longitudinal axis = $2\frac{1}{2}''$
Length of large opening = 4"
Average width of large opening = $4\frac{3}{4}''$
Length of small opening = $2\frac{5}{8}''$
Width of small opening = $1\frac{1}{4}''$

Mine Roof Bolt 22

Overall length = 8 feet
Diameter = $\frac{3}{4}$ inch

Angle Washer 64

Length of leg 66 = 3 inches
Length of leg 68 = 3 inches
Diameter of hole 62 = $1\frac{1}{4}$ inches
Thickness = $\frac{5}{8}$ inch
Width of legs 66, 68 = $4\frac{1}{4}$ inches

Tie Member 32

Diameter = $\frac{3}{4}$ inch
Length of threads 34 = 9 inches
Outside diameter of washer 70 = 2 inches
Length = 12 feet

Spherical Washer 30

Outside diameter = 2 inches
Thickness = $\frac{1}{2}$ inch

OPERATION

The following is the preferred procedure for installation of the truss system of this invention using a single-boom roof bolter with 45° angle drilling capability.

1. Locate and mark the position of the holes 24 which extend upwardly and outwardly at an angle of 45° and are located a distance of approximately 1/5 of the width of the passageway 10 from the ribs 15 of the passageway 10.
2. Drill vertical starter holes of about $1\frac{3}{8}$ to $1\frac{7}{8}$ inches diameter approximately 2 inches deep.
3. Drill one $1\frac{3}{8}$ inch diameter hole 24 at an angle of 45° toward a rib 15 to the desired depth. The end of the hole 24 should be such that a vertical projection would place it at least 2 feet within the rib.
4. Assemble the spherical washer 30 and angle washer 64 on bolt 22.
5. Place bolt 22 through opening 54 in transition plate 38 and a resin cartridge within hole 24.
6. Drive bolt and resin cartridge into hole 24 such that resin cartridge is broken as the bolt 22 approaches the end of hole 24. Thereafter mix the resin the required period of time and torque the bolt 22 to produce 10,000 pound tension in the bolt 22.
7. Repeat steps 3–6 for the other mine roof bolt 22.
8. Place horizontal tie member 32 through the saddle 58 of one transition plate 38 and back through the saddle 58 of the other transition plate 38.
9. Place hardened steel washer 70 and nut 36 on threads 34 of one end of tie member 32 and rotate the nut 36 such that only enough threads 34 on the other end of tie member 32 protrudes through the saddle of the other transition plate 38 that the hardened steel washer 70 and nut 36 can be started on threads 70 and nut 36 can be started on threads 34. Opening 56 allows some additional clearance for placement of the washer 70 and for positioning a tool to rotate nut 36.

10. Tighten nut 36 on said other end of tie member 32 by hand or a power tool such that a tension of about 10,000 pounds is placed in tie member 32.

The following options may be used if desired:

A. The tension in bolt 22 and tie member 32 could be varied. It has been found that the transition plate 38, described above, can sustain a load of about 27,000 pounds before failure in tension.

B. The mine roof bolts 22 could be initially installed to somewhat lower load levels, the tie member 32 could be installed to the desired load level and then the load levels in the bolts 22 increased to the desired level.

C. Short extensions could be attached to the tie member 32 to account for errors in hole 24 placement or an irregular mine roof 12.

D. Blocking devices, such as block 72 of FIG. 1, made of metal or wood, could be used between the tie member 32 and mine roof 12.

E. If mine roof conditions permit or if other starting techniques and devices are used, it may be possible to eliminate the need for starter holes for holes 24.

F. In place of a resin cartridge mechanical devices such as the well known expansion shell could be used.

G. In order to assist in keeping the tie member 32 at the proper location within the saddle 58 a washer 70 could be made rectangular in shape instead of round.

H. Dual-boom or any other type of suitable bolter or any other kind of drilling mechanism may be used in place of a single boom bolter.

Although we have described our invention hereinabove in considerable detail, we do not wish to be limited narrowly to the exact and specific particulars disclosed, but we may also use such substitutes, modifications, or equivalents as are included within the scope and spirit of the invention or pointed out in the appended claims.

We claim:

1. A transition plate for connecting the inclined and horizontal chords of a mine roof truss comprising a generally flat body having a longitudinal axis extending between the body ends, one face of said flat body defining a generally planar plate bearing surface adapted to be closely received against a mine roof, a first opening in said flat body adjacent one end of the flat body positioned on said longitudinal axis and adapted to receive a mine roof bolt, and an elongated saddle portion extending outwardly from said one face along said longitudinal axis adjacent said other end adapted to receive a tie member.

2. The transition plate of claim 1 wherein the sides and said one end of said flat body are bent outwardly from said one face.

3. The transition plate of claims 1 or 2 wherein a second opening is provided in said flat body adjacent said other end of said flat body and said elongated saddle portion extends between said other end and said second opening.

4. The transition plate of claim 3 wherein the outer portion of the elongated saddle portion extends at an angle of 3 degrees to said longitudinal axis.

5. The transition plate of claim 3 wherein the sides of said flat body taper towards each other at said other end.

6. The transition plate of claim 3 wherein said one face is in contact with a mine roof, a mine roof bolt extends through said first opening and is anchored in a mine roof, and one end of a tie member extends in said saddle portion and is attached hereto.

7. The transition plate of claim 6 wherein an angle washer is positioned between the head of said mine roof bolt and said plate with one leg of the angle washer contacting said one end of said plate.

* * * * *